US005263582A

United States Patent [19]

Schaaf

[11] Patent Number: 5,263,582

[45] Date of Patent: Nov. 23, 1993

[54] CHAIR BASE SHIPPING CARTON

[75] Inventor: Donnie Schaaf, Shelbyville, Ky.

[73] Assignee: L&P Property Management Company, Chicago, Ill.

[21] Appl. No.: 974,248

[22] Filed: Nov. 10, 1992

[51] Int. Cl.[5] ..... B65D 85/00; B65D 85/62

[52] U.S. Cl. ..... 206/326; 206/504; 229/110; 220/23.4; 53/396

[58] Field of Search ..... 206/326, 504; 229/110, 229/918; 220/23.4; 53/396

[56] References Cited

U.S. PATENT DOCUMENTS 3,080,096 3/1963 Carfizzi ..... 206/504

4,283,001 8/1981 Meyers ..... 229/110

*Primary Examiner*—William I. Price

*Attorney, Agent, or Firm*—Wood, Herron & Evans

[57] ABSTRACT

A shipping carton for five legged chair bases is disclosed. The shipping carton is hexagonal with rectangular sides and four obtuse corner angles and two acute corner angles. The configuration of the carton allows for more efficient loading of a standard truck trailer or other shipping vehicle. In addition, the load has more stability and structural integrity than pentagonal cartons previously used for shipping five legged chair bases. The shipping carton of the present invention is economically formed from a single flat sheet of foldable material such as corrugated paperboard.

13 Claims, 2 Drawing Sheets

25

CHAIR BASE SHIPPING CARTON

BACKGROUND OF THE INVENTION

This invention relates to shipping cartons and, more particularly, to shipping cartons for five legged chair bases.

A shipping carton for five legged chair bases customarily is pentagonal and contains multiple chair bases for economy and efficiency. In addition, trailers used for transporting the pentagonal cartons are commonly filled to capacity with the maximum number of densely packed cartons possible on a single shipment.

Due to the unique geometry of five legged chair bases and pentagonal shaped cartons, trailers used in shipping these cartons are not entirely filled in that voids and unused space are inevitable. The efficiency of packing a trailer with pentagonal shaped cartons is simply limited.

SUMMARY OF THE INVENTION

It has been one objective of this invention to provide a shipping carton for multiple legged chair bases and particularly for five legged chair bases which efficiently maximizes the number of chair bases which may be loaded into a truck trailer or a shipping container.

It has been a further objective of this invention to provide a shipping carton for five legged chair bases which makes for a more sturdy load of cartons during transport.

These objectives of the invention are obtained by a hexagonal shipping carton which is adapted for shipping five legged chair bases. A shipping carton according to the current invention has six interconnected rectangular sides. Each of the six sides are joined to form an obtuse angle, with the exception of two of the six carton angles which are acute. The two acute angles are immediately separated by a single obtuse angle which projects toward the interior of the shipping carton. The shipping carton has both a top and a bottom which are formed from cooperating flaps extending from each of the rectangular sides of the carton.

The shipping carton is formed from a single flat sheet of foldable material which has six interconnected and serially aligned rectangular sides. Each side is connected to the adjoining sides by a fold line which serves to form the obtuse and acute angles of the shipping carton.

Each rectangular side has a flap on both the top and the bottom. Unlike the rectangular sides which are joined along a fold line, each top flap and each bottom flap is separated by a slit from the neighboring top and bottom flaps. When the shipping carton is formed from the flat piece of material, the top and the bottom flaps all cooperate to form the carton's top and bottom, respectively.

In use, the multiple legged chair bases are inserted into a shipping carton of the present invention and oriented such that the outer end of each leg of the chair base is received by a corner of the shipping carton. Multiple chair bases can be packed in a single shipping carton and the shipping cartons can be arranged in a nested and stacked configuration in a truck trailer or other shipping vehicle. In this manner, a greater number of chair bases can be shipped on a single vehicle than with conventional pentagonal shipping cartons.

BRIEF DESCRIPTION OF THE DRAWINGS

The objectives and features of the invention become more readily apparent from the following detailed description taken in conjunction with the accompanying drawings in which.

DETAILED DESCRIPTION

Figure 1:
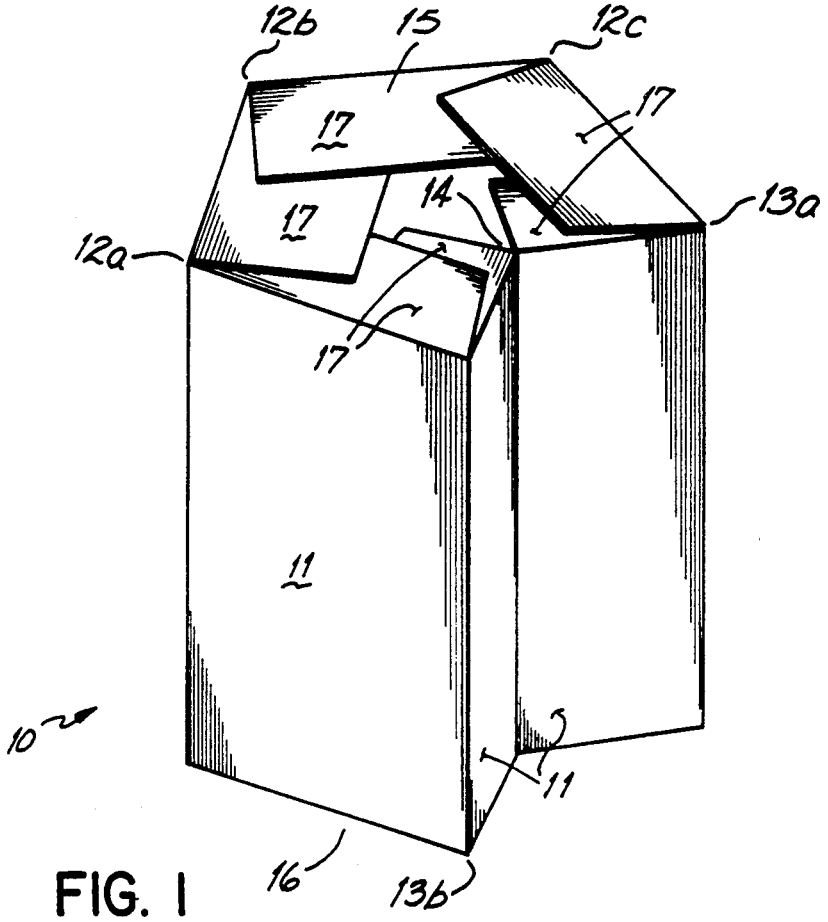
FIG. 1 is a perspective view of a shipping carton of the present invention.

A shipping carton 10 according to the present invention has six rectangular sides 11 as seen in FIG. 1. The six sides 11 are interconnected at fold lines which serve to form corner angles for the shipping carton 10. When erected, the carton 10 has three adjacent obtuse corner angles 12*a*, 12*b*, 12*c* and two acute corner angles 13*a*, 13*b* which are separated by a fourth obtuse corner angle 14. The fourth obtuse corner angle 14 which is adjacent to each of the two acute corner angles 13*a*, 13*b* is the only one of the obtuse angles which projects inward toward the interior of the carton 10.

Figure 3:
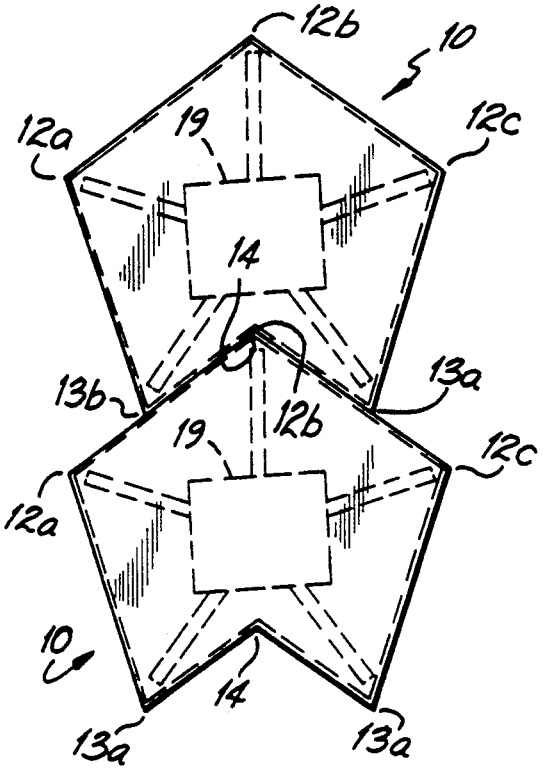
FIG. 3 is a plan view of two shipping cartons according to the present invention which are nested for packing and shipping.
Figure 4:
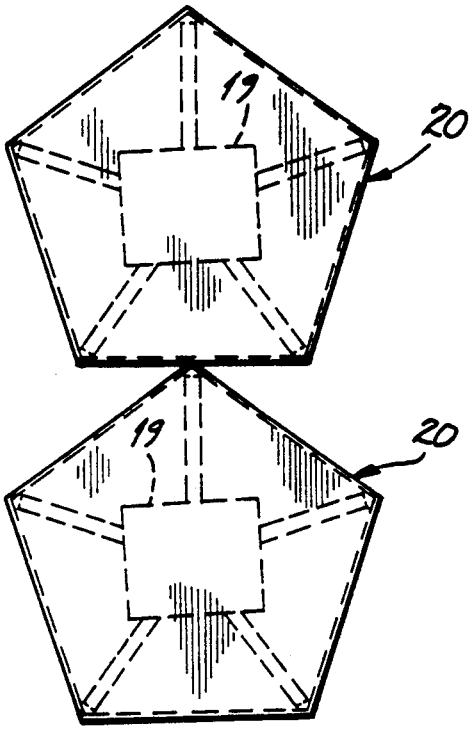
PRIOR ART FIG. 4
FIG. 4 is a plan view of two prior art shipping cartons.

The shipping carton has a top 15 and a bottom 16 which are formed by the combination of six top flaps 17 and six bottom flaps 18 joined to the respective ends of each rectangular side 11. When the shipping carton 10 is filled with five legged chair bases 19, each of the corner angles, with the exception of the lone inwardly projecting obtuse corner angle 14, is adapted to receive the outer end of one leg of the chair base 19, as can be seen in FIG. 3. In this way, the shipping carton 10 has less void space when filled than a conventional pentagonal carton 20 such as the carton 20 illustrated in FIG. 4.

Figure 5:
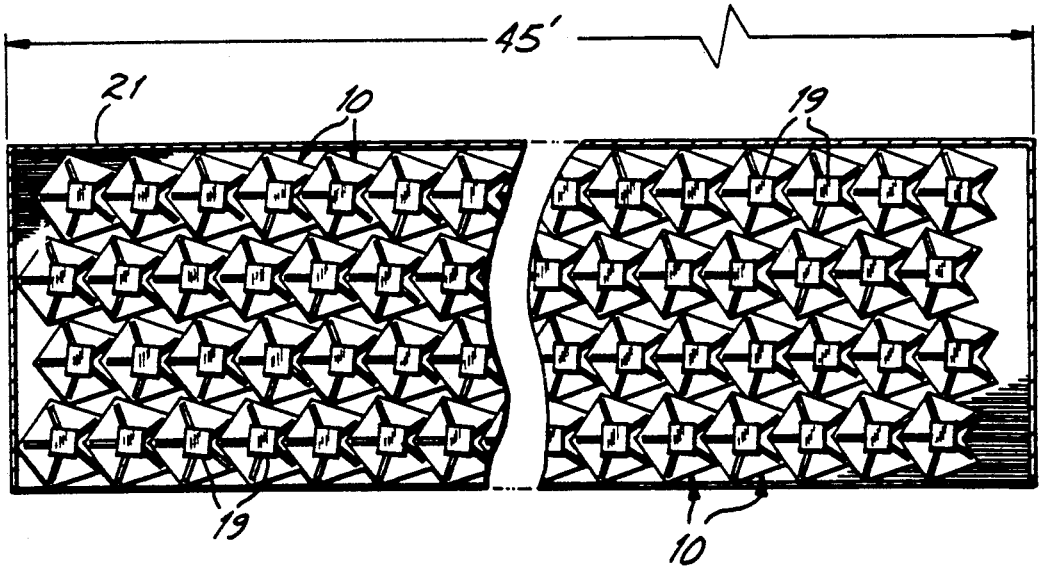
FIG. 5 is a plan view of a truck trailer loaded with shipping cartons according to the present invention.

Shipping cartons 10 of the present invention are more economical in that more chair bases 19 can be transported in the same space as compared to pentagonal cartons 20 currently used in the industry. In addition to packing multiple chair bases in a single shipping carton, the configuration of a shipping carton 10 according to the present invention allows multiple cartons to be arranged in a nested relationship as shown in FIG. 3. Such a nested arrangement allows for a greater number of shipping cartons 10 to be loaded on a single 45' long truck trailer 21 FIG. 5, than can be accomplished with a standard pentagonal shipping carton 20. Nesting the obtuse corner angle 12*b* of one shipping carton with the lone inwardly projecting obtuse corner angle 14 of a second carton allows for more compact, efficient, and structurally sturdy loading of a shipping vehicle, as seen in FIGS. 3 and 5.

Figure 2:
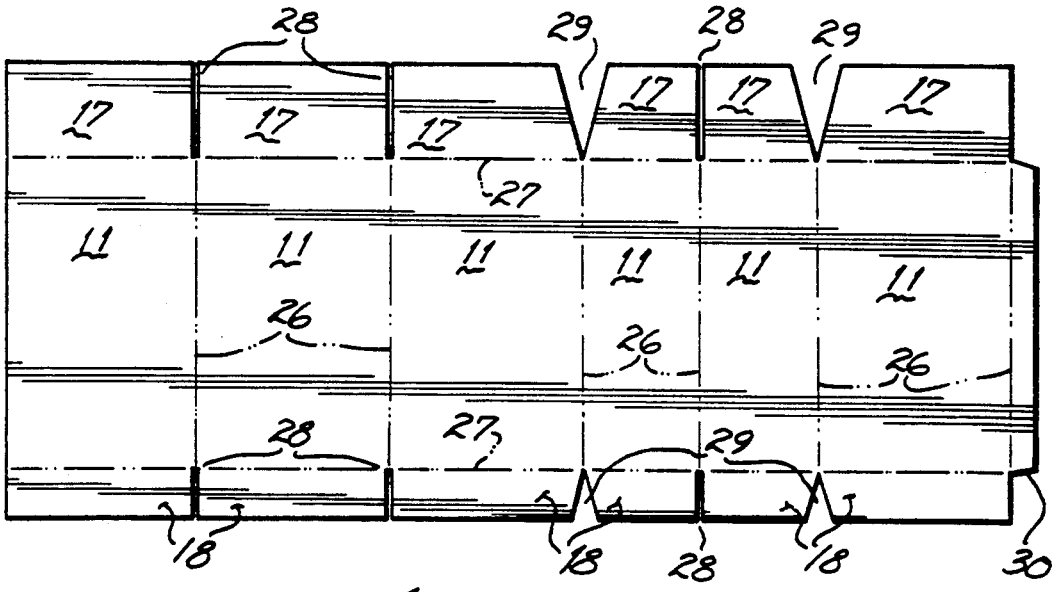
FIG. 2 is a plan view of the foldable material used to form the shipping carton.

The shipping carton 10 of the present invention is easily formed from a single flat sheet 25 of foldable material such as corrugated paperboard. The configuration of such a sheet is shown in FIG. 2. The six rectangular sides 11 are serially aligned and interconnected by five parallel fold lines 26 which ultimately form the corner angles of the shipping carton 10. Perpendicular to these five parallel fold lines 26 are a pair of parallel flap fold lines 27 which separate the six top flaps 17 and six bottom flaps 18, respectively, from the six rectangular sides 11. Unlike the sides, each flap 17 is not joined to its neighboring top flaps but is separated by either a rectangular slit 28 or V-shaped slit 29. Similarly, each bottom flap 18 is separated from the adjacent bottom flaps by either of these two types of slits. These slits extend from fold lines 26 which ultimately form the corner angles of the shipping carton 10. All of the slits which extend from a fold line which eventually becomes an obtuse corner angle 12*a*, 12*b*, 12*c*, 14 is a rectangular slit 28. Slits which extend from the fold lines 26 associated with the two acute corner angles 13*a*, 13*b* are V-shaped slits 29.

In order to form the shipping carton 10 from the flat sheet 25, a side tab 30 is provided along an external edge of one of the two outermost sides and between the two parallel flap fold lines 27 as shown in FIG. 2. The side tab 30 is used to join the two peripheral opposing sides on the flat sheet 25 and to form one of the corner angles of the shipping carton. Any adhesive, such as glue or tape, or industrial staples can be used on the side tab 30 to join the two peripheral sides.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims.

I claim:

1. A shipping carton for shipping multiple legged chair bases comprising:

a carton having a top, a bottom, and multiple rectangular sides, each of said sides being connected to two other of said sides at a fold line, a corner angle being defined at each of said fold lines by the intersection of a pair of said sides, at least two of said corner angles being obtuse and two being acute, said two acute corner angles being located adjacent to and separated by one of said obtuse corner angles.

2. A shipping carton of claim 1 wherein each corner angle of said carton except for said one obtuse corner angle is adapted to receive in close proximity thereto one end of one leg of said multiple legged chair base when inserted therein.

3. A shipping carton of claim 1 wherein said carton is adapted to be packed such that said one obtuse corner angle of a first said carton is nested in close proximity to an obtuse corner angle of a second said carton.

4. A hexagonal shipping carton for shipping five legged chair bases comprising:

a carton having a top, a bottom, and six rectangular sides, each of said six sides being connected to two other of said sides at a fold line, a corner angle being defined at each of said fold lines by the intersection of a pair of said sides, four of said corner angles being obtuse and two being acute, said two acute corner angles being located adjacent to and separated by one of said obtuse corner angles.

5. The shipping carton of claim 4 wherein said one obtuse corner angle is formed by two adjacent sides of said carton which project inward toward the interior of said carton.

6. A shipping carton according to claim 4 wherein each corner angle of said carton except for said one obtuse corner angle is adapted to receive in close proximity thereto one end of one leg of said five legged chair base when a chair base is inserted therein.

7. A shipping carton according to claim 4 wherein said carton is adapted to be packed such that said one obtuse corner angle of a first said carton is nested in close proximity to an obtuse corner angle of a second said carton.

8. A shipping carton according to claim 4 wherein a transverse cross section of said carton has one line of symmetry.

9. A shipping carton according to claim 4 wherein said carton is made of corrugated paperboard.

10. A shipping carton according to claim 4 wherein said carton is formed from a unitary flat sheet of foldable material in which said six rectangular sides are serially aligned and interconnected by parallel fold lines, each of said six rectangular sides having a top flap and an opposing bottom flap, a combination of all six said top flaps and all six said bottom flaps being adapted to form said top and said bottom of said carton respectively when said sheet is created into a carton configuration.

11. A shipping carton according to claim 10 wherein each said top flap and each said bottom flap is separated from said adjoining flap by a slit, said sheet having a fold pattern including two parallel longitudinal folds separating said sides from said top flaps and said bottom flaps, respectively, each said slit extending from said acute corner angles being V-shaped, each said slit extending from said obtuse corner angles being rectangular, and a side tab extending between said longitudinal folds on one lateral end of said sheet for adjoining lateral sides of said sheet to form one of said corner angles.

12. A hexagonal shipping carton for shipping five legged chair bases comprising:

a cardboard carton having a top, a bottom, and six rectangular sides, each of said six sides being connected to two other of said sides at a fold line, a corner angle being defined at each of said fold lines by the intersection of a pair of said sides, four of said corner angles being obtuse and two being acute, said two acute corner angles being located adjacent to and separated by one of said obtuse corner angles which projects inward toward the interior of said carton, each said corner angle expect for said one obtuse corner angle being adapted to receive in close proximity thereto one end of one leg of said five legged chair base when a chair base is inserted therein;

said carton having one line of symmetry in a transverse cross section;

a unitary flat sheet of foldable material in which said six rectangular sides are serially aligned and interconnected by parallel fold lines, each of said six rectangular sides having a top flap and an opposing bottom flap, a combination of all six said top flaps and all six said bottom flaps being adapted to form said top and said bottom of said carton respectively when said sheet is created into a carton configuration; and a fold pattern in said sheet including two parallel longitudinal folds separating said sides from said top flaps and said bottom flaps, respectively, a V-shaped slit extending from said acute corner angles, a rectangular slit extending from said obtuse corner angles, and a side tab extending between said longitudinal folds on one lateral end of said sheet for joining lateral sides of said sheet to form said carton.

13. A method for packing a plurality of hexagonal shipping cartons for five legged chair bases wherein each said carton has six rectangular sides, each of said rectangular sides being connected to two other of said sides at a fold line, a corner angle being defined at each of said fold lines by the intersection of a pair of said sides, four said corner angles being obtuse and two being acute, said two acute corner angles being located adjacent to and separated by one of said obtuse angles which projects inward toward the interior of said carton, a transverse cross section of said carton having one line of symmetry, said method comprising:

arranging said cartons whereby said line of symmetry of a first carton contacts and forms a collinear extension of said line of symmetry of a second carton.

* * * * *